US005639272A

United States Patent [19]

Henderson et al.

[11] Patent Number: 5,639,272

[45] Date of Patent: Jun. 17, 1997

[54] TROLLING MOTOR CLUTCH MECHANISM

[75] Inventors: William A. Henderson, Starkville; Rodney D. Davis, Tupelo, both of Miss.

[73] Assignee: Brunswick Corporation, Lake Forest, Ill.

[21] Appl. No.: 490,580

[22] Filed: Jun. 15, 1995

[51] Int. Cl.[6] ..... B60L 11/02

[52] U.S. Cl. ..... 440/6; 440/75

[58] Field of Search ..... 440/6, 7, 75; 74/411, 74/461, DIG. 10

[56] References Cited

U.S. PATENT DOCUMENTS

| | | | |
|---|---|---|---|
| 3,926,067 | 12/1975 | Blanchard et al. | 74/461 |
| 3,989,000 | 11/1976 | Foley, Jr. | 440/6 |
| 4,746,311 | 5/1988 | Kraus | 440/6 |

*Primary Examiner*—Stephen Avila
*Attorney, Agent, or Firm*—Rosenblatt & Redano, P.C.

[57] ABSTRACT

An improved technique for operation and assembly of trolling motors is disclosed. The direction indicator assembly is flexibly mounted to allow its initial assembly in any direction. The direction indicator can then be flexibly moved and twisted into the proper orientation where its arrow aligns with the direction of the thrust motor. If any fine-tuning is required, the direction indicator can then be turned relative to a gear mounted to it. The positioning system for the stem supporting the thrust motor includes a clutch system to avoid reverse movements of the drive system for the stem supporting the thrust motor. Fine adjustments can be made to the direction indicator, even after the thrust motor has struck a fixed object and rotated through the use of a clutching system. The clutching system is automatic and allows the continuation of steering commands to the thrust motor once the shock load that has caused the clutch to disengage is removed.

4 Claims, 3 Drawing Sheets

TROLLING MOTOR CLUTCH MECHANISM

FIELD OF THE INVENTION

The field of this invention relates to clutch mechanisms for trolling motors for pleasure boats and more particularly to techniques for preventing damage to the positioning motor by use of a clutching mechanism.

BACKGROUND OF THE INVENTION

In the past, typical trolling motor assemblies have had a thrust motor and propeller, both mounted on an orientation shaft. The shaft was operated with a controller by the fisherman to turn the boat as needed. The housing generally included a motor to drive the shaft which supported the thrust motor. The positioning motor could turn the support shaft for the thrust motor within a predetermined range of movement. This range of movement was controlled by a rack connected to the drive system between the positioning motor and the column supporting the thrust motor. The rack would hit fixed objects at either end of its travel, which would then stall the positioning motor, indicating the extent of rotational travel of the thrust motor for course changes in the boat.

In the past, the top of the trolling motor housing had a position indicator so that the fisherman could see easily the orientation of the thrust motor prior to engaging power. This would avoid lurches in unexpected directions which could cause damage to the boat or injury to its occupants. The positioning indicator in past designs was generally interengaged with the same rack which acted as the travel stop for the rotational movement of the column supporting the thrust motor. The direction indicator was generally a molded piece that had a pinion formed at the bottom of it. The trolling motor housing was fully assembled and then the assembler was charged with installing the direction indicator. In the past, the thrust motor alignment was observed by the assembler, who then took the indicator and noted the position of the arrow on the indicator. The assembler would then attempt to align the arrow on the indicator with the observed position of the thrust motor and apply direct pressure on top of the direction indicator to push it into engagement with the rack which acted as a travel stop for the support shaft of the thrust motor. The problem occurred in prior designs because the gear teeth on the pinion, which was part of the direction indicator system, would not necessarily line up with the teeth on the rack when the assembler thought the arrow on the position indicator was aligned with the thrust motor. Accordingly, if force was applied to get the direction indicator to enter the housing and engage the rack with its pinion, problems ensued with teeth breaking. On the other hand, to facilitate the assembly, the assembler could always cock the position indicator until it aligned with the teeth on the rack. However, this resulted in a misalignment between the arrow on the position indicator and the actual orientation of the thrust motor down below. Even as little as a one-half or a one tooth misalignment between the pinion on the direction indicator and its proper position against the rack caused significant angular difference in the direction indicator by the direction indicator and the actual orientation of the thrust motor.

Accordingly, the apparatus and method of the present invention was developed to alleviate these problems in the assembly of the trolling motor. One of the objects of the invention was to allow a greater degree of adjustability in the assembly technique so that proper orientation could be achieved between the position of the thrust motor and the indication on the direction indicator. Another object of the invention was to allow the trolling motorhead to be fully assembled, regardless of the position of the thrust motor, and to flexibly mount the direction indicator so that coarse and fine adjustments could be made, even after the entire trolling motorhead is fully assembled. Another object of the invention was to allow for a clutching system between the drive for the shaft connected to the thrust motor and the motor which positions that shaft. Yet another object of the invention was to allow the fisherman to make manual corrections on the direction indicator subsequent to an impact with a fixed object that would have angularly rotated the thrust motor without a corresponding rotation of the direction indicator.

SUMMARY OF THE INVENTION

An improved technique for operation and assembly of trolling motors is disclosed. The direction indicator assembly is flexibly mounted to allow its initial assembly in any direction. The direction indicator can then be flexibly moved and twisted into the proper orientation where its arrow aligns with the direction of the thrust motor. If any fine-tuning is required, the direction indicator can then be turned relative to a gear mounted to it. The positioning system for the stem supporting the thrust motor includes a clutch system to avoid reverse movements of the drive system for the stem supporting the thrust motor. Fine adjustments can be made to the direction indicator, even after the thrust motor has struck a fixed object and rotated through the use of a clutching system. The clutching system is automatic and allows the continuation of steering commands to the thrust motor once the shock load that has caused the clutch to disengage is removed.

DETAILED DESCRIPTION OF THE PREFERRED EMBODIMENT

Figure 1:
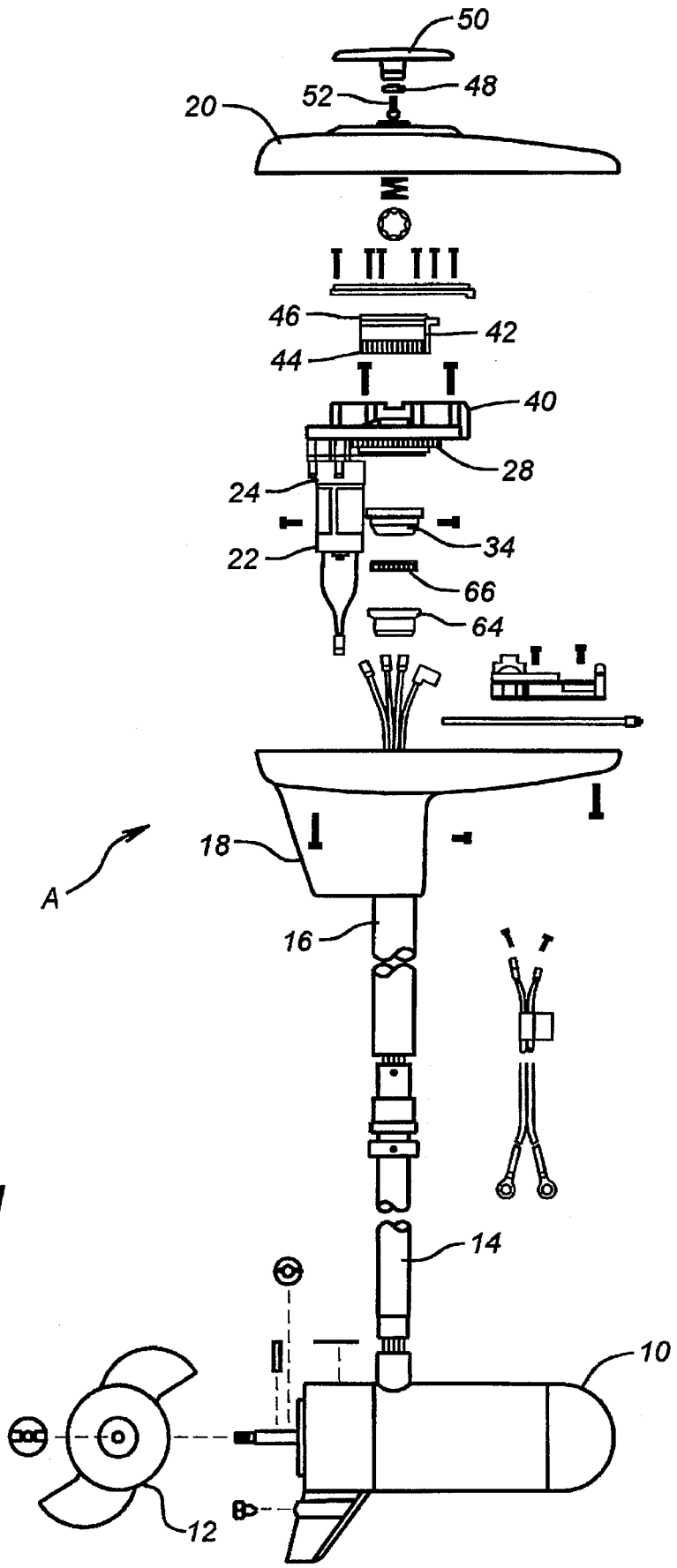
FIG. 1 is an exploded elevational view of the trolling motor, showing the direction indicator and clutch mechanism of the present invention.

The apparatus A of the present invention is illustrated in the exploded view of FIG. 1. The components pertinent to the present invention will be described. A thrust motor 10 drives the propeller 12. The thrust motor 10 is supported by shaft 14. Shaft 14 extends through sleeve 16 and then to lower housing 18. The various components for controlling the positioning of the thrust motor 10 are located within the lower housing 18 and upper housing 20.

Figure 3:
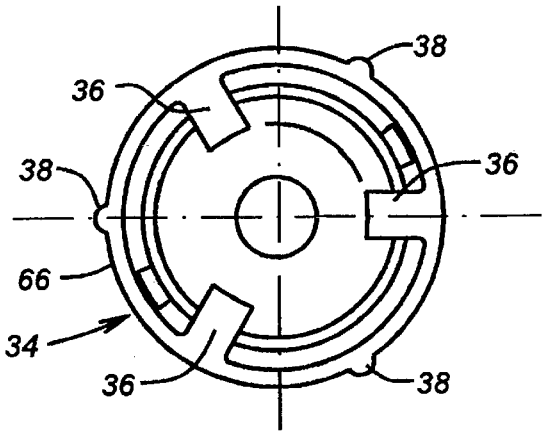
FIG. 3 shows one-half of the clutch mechanism that is attached to the support shaft of the thrust motor.
Figure 4:
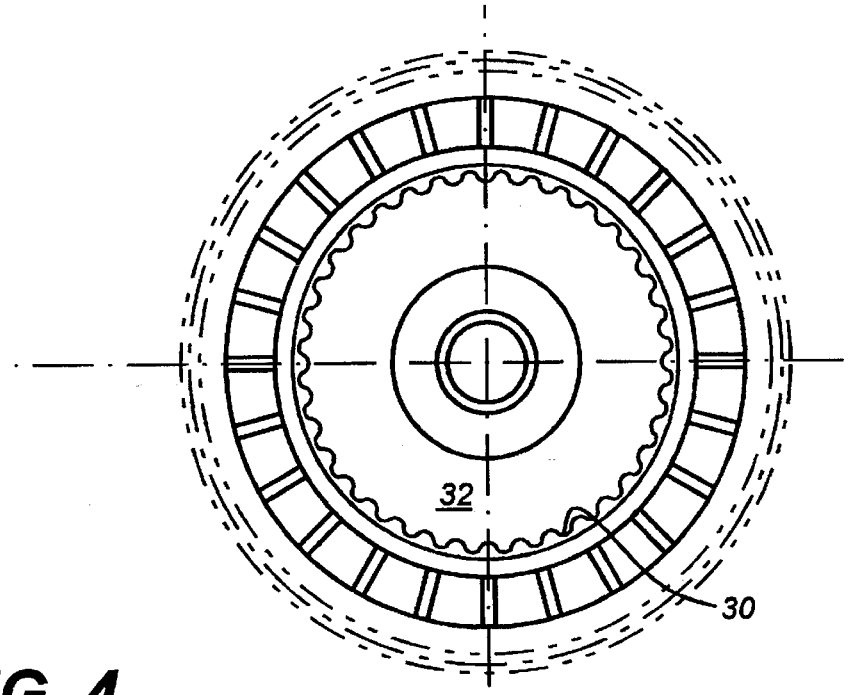
FIG. 4 shows the other portion of the clutch mechanism which is part of the drive system for orientation of the shaft supporting the thrust motor.
Figure 5:
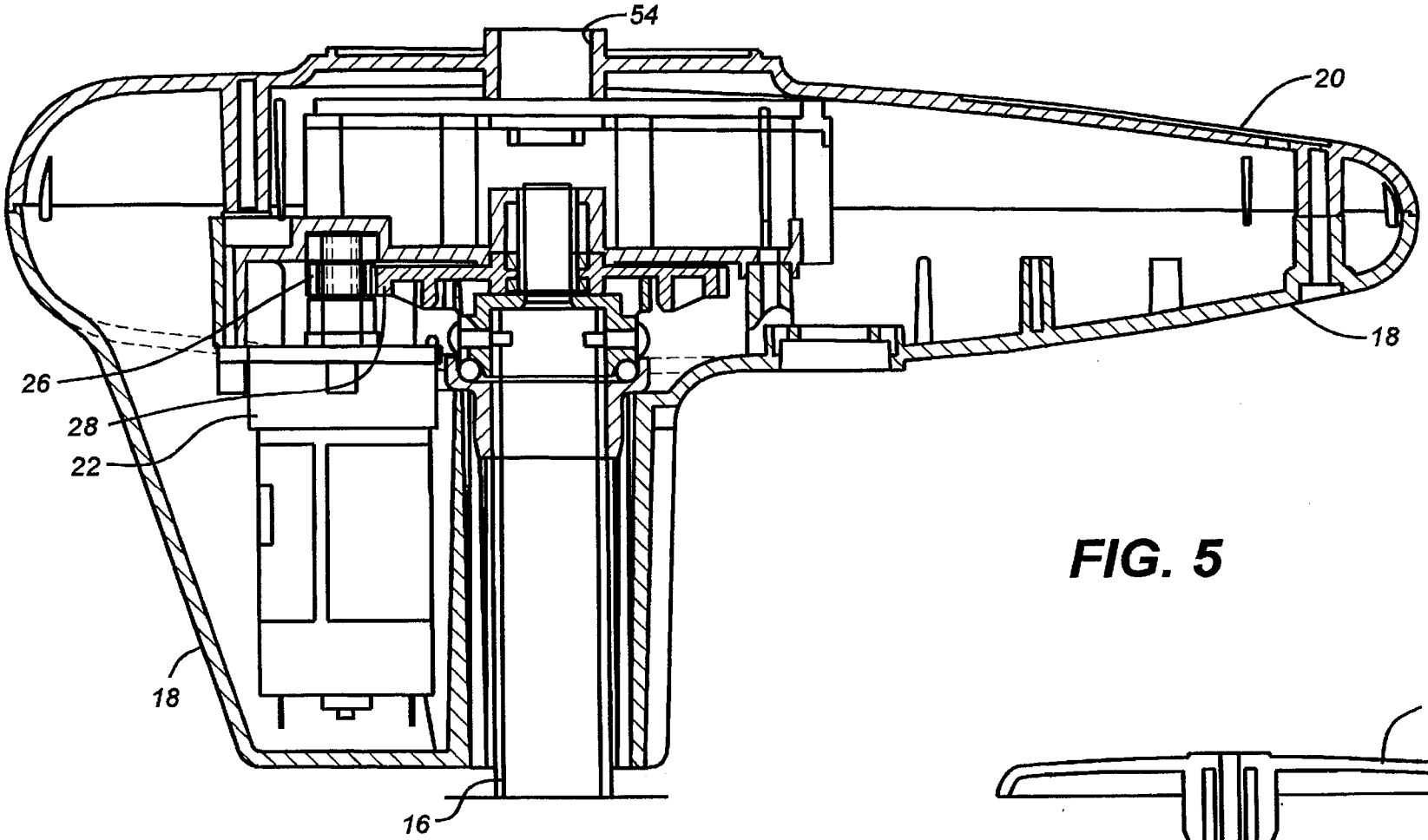
FIG. 5 is an assembled view of FIG. 1, shown in section in the area of the positioning motor for the shaft supporting the thrust motor, with the direction indicator removed.

A positioning motor 22 is connected to a cycloidal gear reduction assembly 24. In the preferred embodiment, motor 22 rotates at about 5,000 rpm and the cycloidal reduction is approximately a ratio of 40:1, making the output speed of the pinion 26 (see FIG. 5) somewhat over 100 rpm. Pinion 26 drives a gear 28, a top view of which is also shown in FIG. 4. Gear 28 has external teeth that mesh with pinion 26 and internally has a plurality of protrusions 30, which in the preferred embodiment are a series of 36 bumps around the periphery of an internal bore 32 in gear 28. Gear 28, being larger than pinion 26, turns more slowly than pinion 26. In the preferred embodiment, the bumps 30, which comprise a part of the clutch assembly as will be described below, are approximately 0.060" in radius, with approximately 36 distributed around a diameter of approximately 1⅞". Mating to the protrusions 30, and forming the other part of the clutch assembly, is ring 34, illustrated in FIG. 3. Ring 34 is resiliently mounted with respect to the shaft 14. A series of tabs 36 facilitates flexing action of ring 34 in an over-torque situation, as will be described below. On the outside of ring 34 are three protrusions 38. Protrusions 38 are designed to mesh between the protrusions 30 on gear 28. Since the shaft 14 is mounted to rotate in tandem with ring 34, it can be readily seen that when the motor 22 is engaged, pinion 26 turns gear 28 which, in turn through the protrusions 30, drives the protrusions 38 on ring 34 and thus repositions the shaft 14 and the thrust motor 10 connected thereto.

Figure 2:
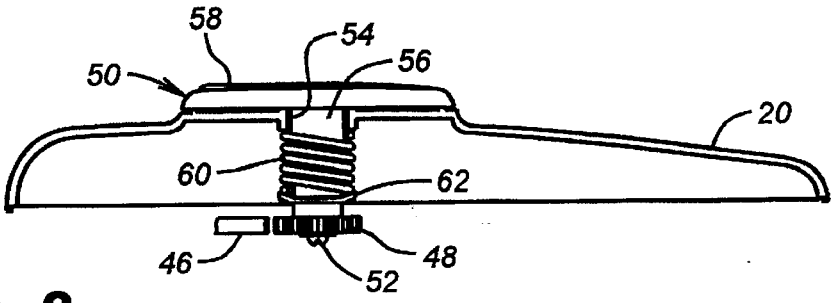
FIG. 2 is a detailed view of the upper housing of the trolling motor assembly, showing the direction indicator and stem and the mounting thereof.

The motor 22 and the gear reduction assembly 24 are supported by a rack guide 40. The rack guide 40 supports the rack 42. Rack 42 has two sets of teeth. The lower row 44 engages gear 28. The upper row 46 engages gear 48, which is secured to the direction indicator 50 by screw 52. As shown in FIG. 2, the upper housing 20 has an opening 54 through which extends stem 56 of indicator 50. Indicator 50 has an arrow 58 on top to indicate to the fisherman the position of the thrust motor 10.

A spring 60 bears on retaining ring 62. Since spring 60 is larger than opening 54, a biasing force that pulls the direction indicator 50 downwardly against the upper housing 20 is created. This downward force exerted by spring 60 prevents the direction indicator 50 from rattling when the boat is underway or the thrust motor 10 is operating or the positioning motor 22 is operating. It should be noted that since gear 48 is secured to the stem 56 with screw 52, it is still possible to make fine-tuning adjustments in the position of arrow 58, even after gear 48 is meshed with the upper row 46 of rack 42.

The rack guide 40 also serves as a travel stop in either direction for rack 42, thus limiting the amount of angular rotation of shaft 14, which in turn limits the angular movement of thrust motor 10, left or right.

Figure 6:
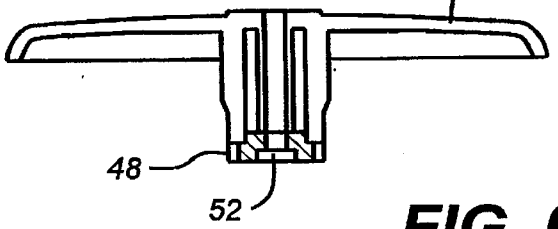
FIG. 6 is the sectional elevational view of the direction indicator, which is assembled into the bore at the top of FIG. 5.

FIG. 6 shows the section view of the directional indicator 50, showing the assembly of the gear 48 with the screw 52. As better shown in FIG. 5, the gear 48 slips through the opening 54 in the upper housing 20.

Ultimately, the shaft 14 is engaged to ring 34, which, as previously described, selectively meshes with gear 28 so that in normal operations the operation of motor 22 turns the pinion 26 which, in turn, turns gear 18 which, through the clutch mechanism of protrusions 30 and ring 34 with its protrusions 38, results in an angular displacement of the shaft 14. It also results in lateral displacement of rack 42 because the lower row 44 engages the gear 28. It also results in an angular displacement of the direction indicator 50 because gear 48 is engaged to the upper row 46.

For stability at the upper end of shaft 14, a bearing support ring 64 supports bearings 66 within lower housing 18.

The drive assembly comprises positioning motor 22, gear reduction assembly 24, pinion 26, and gear 28. The clutch assembly comprises protrusions 38 on ring 34 and protrusions 30 on gear 28.

Having now described the construction of apparatus A of the present invention, it can readily be seen why it can be more easily assembled than the prior designs. The direction indicator 50 can be assembled in any position in which it will easily mesh gear 48 into the upper row 46 of rack 42. This is true regardless of whether initially when assembled the arrow 58 points in a completely different direction than the thrust motor 10. Having fully assembled the items shown in FIG. 1, with the arrow 58 misaligned from the direction of the thrust motor 10, the adjustments can then be undertaken. The assembler merely lifts up on direction indicator 50, compressing spring 60. This releases the gear 48 from the upper row 46 of rack 42. Having effected such a disengagement, the direction indicator 50 can be rotated so that it is in near close alignment to the direction of the thrust motor 10. However, at the point where the gear 48 snaps into engagement with the upper row 46 of rack 42, the arrow 58 may still be somewhat angularly misaligned from the true position of the thrust motor 10. At that time a fine adjustment can be made. With the gear 48 still engaged to the upper row 46 of rack 42, the assembler merely grabs the direction indicator 50 and applies a slight twist. There is a frictional resistance due to the assembly using screw 52 as between the gear 48 and the stem 56. Accordingly, the fine adjustment can be made by rotating the direction indicator 50 with respect to gear 48, which is locked into its position at that time due to its being meshed into the upper row 46 of the rack 42. Having obtained the proper alignment, the assembly procedure is complete. It should be noted that although relative motion as between gear 48 when held stationary by the rack 42 and the direction indicator 50 is possible, during normal operations there is no looseness. In other words, it has to be an intentional desire to further turn the direction indicator 50 as part of the assembly procedure.

In the unforeseen possibility that the thrust motor 10 hits a fixed object, it could receive an angular input that may want to turn the cycloidal gears 24 in a reverse direction. Since it is not desirable to run the gears 24 in a reverse direction, the clutch mechanism as previously described has been employed. However, even when the clutch mechanism which comprises of protrusions 30 and 38 effects a disengagement, the net result is that the thrust motor has turned when striking a fixed object but the rack 42 has remained stationery. Since rack 42 has remained stationary, the direction indicator 50 has also not turned in corresponding amount to the movement of the thrust motor 10 when it strikes the object. After the boat has moved away from the object it has just struck, it is desirable to get the direction indicator 50 back in alignment with the true position of the thrust motor 10. The fisherman can easily make such changes to reestablish the alignment of thrust motor 10 with the arrow 58 on direction indicator 50. All the fisherman has to do is either lift up the direction indicator 50 and compress the spring 60 until the arrow 58 is approximately in the right position and then release the assembly. If some fine adjustment is still needed, the fisherman can then grab the direction indicator 50 and, with gear 48 engaged to upper row 46 of rack 42, make the fine adjustments himself.

It should be noted that using the cycloidal gearing achieves compactness, noise reduction, and greater reliability. However, the introduction of cycloidal gearing to a trolling motor has brought about the need for a clutch mechanism since, as contrasted with the prior designs, the cycloidal gearing cannot be run in reverse. Prior designs could be run in reverse and when the thrust motor 10 would strike an object and be forced to turn, the drive of prior designs was merely pushed in the opposite direction, basically running the positioning motor such as 22 in the reverse direction. With the drive system now employed, the motor 22 can be driven in either direction electrically but cannot receive mechanical input so that it is forced to run in one of its two directions. Accordingly, the projections 38, being mounted on a flexible plastic member, can flex radially inwardly in the event of an overload from striking an object with the thrust motor 10 to avoid mechanical inputs back to motor 22, which might damage it and the gear system 24. When subjected to an extreme load, the segments 66, each of which support one of the protrusions 38, are capable of flexing to allow radially inward movement of protrusions 38 to disengage from the depressions between protrusions 30.

The foregoing disclosure and description of the invention are illustrative and explanatory thereof, and various changes in the size, shape and materials, as well as in the details of the illustrated construction, may be made without departing from the spirit of the invention.

What is claimed is:

1. A trolling motor assembly for a boat, comprising:

a thrust motor;

a propeller driven by said thrust motor for trolling with the boat;

a shaft connected to said thrust motor;

a motorhead further comprising a positioning motor and a drive assembly;

said shaft extending into said motorhead and into selective driving contact with said drive assembly;

said drive assembly further comprises a first gear driven by said positioning motor;

a second gear mounted to said shaft engaging said first gear during trolling operation and disengaging from said first gear upon a torque input to said shaft of a predetermined value resulting from said thrust motor striking an object;

said first gear is mounted concentrically with said second gear;

said first gear further comprises a plurality of projections facing said second gear; and said second gear comprises a plurality of second projections facing said first projections and extending therebetween.

2. The assembly of claim 1, wherein:

said second gear having an outer periphery which is flexible in its support of said second projections; and whereupon a sudden torque applied to said shaft from said thrust motor striking an object, said outer periphery flexes radially, allowing said second projections to ride over said first projections rather than remaining therebetween.

3. The assembly of claim 2, wherein:

said second projections remain between said first projections when any applied torque to said shaft from said thrust motor hitting an object is reduced to a predetermined value.

4. A method of assembling a clutch assembly in a motorhead positioning drive system for a thrust motor, comprising:

fully assembling the thrust motor via a shaft into the drive system in the motorhead;

providing a clutch assembly between said drive system and said shaft which comprises a driving gear and a concentrically mounted driven gear; and selectively disengaging said shaft from said drive system by radially collapse of one of said gears when a predetermined torque is applied to said shaft from said thrust motor striking an object.

* * * * *